US006254358B1

(12) United States Patent
Merz

(10) Patent No.: US 6,254,358 B1
(45) Date of Patent: Jul. 3, 2001

(54) POSITIVE-DISPLACEMENT PUMP

(75) Inventor: Johann Merz, Schwäbisch Gmünd (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/529,551

(22) Filed: Apr. 14, 2000

(30) Foreign Application Priority Data

Oct. 15, 1997 (DE) ..... 197 45 118

(51) Int. Cl.[7] ..... F04B 49/00
(52) U.S. Cl. ..... 417/310; 417/300
(58) Field of Search ..... 417/297, 299, 417/300, 307, 310, 311, 308

(56) References Cited

U.S. PATENT DOCUMENTS

| | | | | |
|---|---|---|---|---|
| 4,251,193 | * | 2/1981 | Minnis et al. | 417/300 |
| 5,098,259 | * | 3/1992 | Ohtaki et al. | 417/308 |
| 5,236,315 | * | 8/1993 | Hamao et al. | 417/295 |
| 5,810,565 | * | 9/1998 | Eppli | 417/300 |

* cited by examiner

*Primary Examiner*—Teresa Walberg
*Assistant Examiner*—Thor Campbell
(74) *Attorney, Agent, or Firm*—Larson & Taylor PLC

(57) ABSTRACT

A positive-displacement pump for conveying a pressure medium from a container to a consumer, in particular a power steering system includes, a pump package (2); the pump package includes a rotor (3), a cam ring (4) and several operating slides (5) has been inserted into the interior of a housing (1). A bypass flow control valve (11) with a piston (11A) is used for controlling an actual flow. A throttle of the bypass flow control valve (11) is formed by an orifice (12), which is fixed in place on the housing and has an adjustable cross-sectional surface. The cross-sectional surface of the orifice (12) is increased in case of an increasing pressure being applied to the orifice (12). The orifice (12) is arranged so it cannot be displaced in relation to the housing (1). By use of a pressure occurring at the orifice (12), the piston is exclusively displaced against the force of the spring (15), so that the cross-sectional surface of the orifice (12) can be changed as a function of the pressure. The piston is usefully designed as a control pin (13) which is displaceable, independently of the piston (11A) of the bypass flow control valve (11), in relation to the orifice (12). Because of this a regulation of the flow rate can already occur at low numbers of revolutions.

5 Claims, 1 Drawing Sheet

POSITIVE-DISPLACEMENT PUMP

FIELD OF THE INVENTION

The invention relates to a positive-displacement pump for conveying a pressure medium from a container to a consumer, in particular a power steering gear for motor vehicles. A pump package, consisting of a rotor, a cam ring and several operating slides has been inserted into the interior of a housing. The operating slides can be embodied as vanes of a vane cell pump, or as rollers of a roller cell pump, for example. Work chambers are formed between the cam ring and the rotor, which are divided by the operating slides and which are limited in the axial direction by control plates. A bypass flow control valve is used for controlling the actual flow. A throttle of the bypass flow control valve is formed by an orifice having an adjustable cross-sectional surface. In this case the cross-sectional surface can be adjusted as a function of the displacement of a piston, which can be displaced against the force of a spring.

BACKGROUND OF THE INVENTION

Such a positive-displacement pump is known from DE-A1-41 01 210. The throttle orifice of the bypass flow control valve of this pump is arranged on a movable piston. Because of this, the flow control valve controls the positive-displacement pump with a dropping flow characteristic. This means that at an increasing number of revolutions the flow conveyed by the pump is governed. The reduced conveyed flow causes a reduced throughput pressure in the steering system and therefore a reduction of the power consumption.

In another known positive-displacement pump (DE-A1-44 33 598 or U.S. Pat. No. 5,810,565), a control throttle is displaced as a function of the conveyed flow. This means that the regulation takes place independently of the pressure. In this case, the adjustment signal is a pulse. Regulation as a function of the pressure is not possible.

However, with pumps of this type the effect of the reduced power consumption only occurs at increased numbers of revolutions.

BRIEF SUMMARY OF THE INVENTION

The invention is based on the object of creating a positive-displacement pump by simple means, wherein a regulation toward an increased governed flow takes place very rapidly in case of a pressure increase. In particular, the regulation should occur also at lower numbers of revolution.

This object is attained by means of the positive-displacement pump having a pump package and a bypass flow control valve. A throttle for the flow control valve includes an orifice-like throttle opening having an adjustable cross-sectional surface. To this end, the cross-sectional surface of the orifice-like throttle opening is designed so it can be increased in case of an increasing pressure at the orifice-like throttle opening. By means of a pressure occurring at the orifice-like throttle opening, the piston can be exclusively displaced against the force of the spring, so that the cross-sectional surface of the orifice-like throttle opening can be changed as a function of the pressure. Because of this, the piston can be easily and rapidly adjusted as a function of the conveying pressure. At lower pressures, for example at 4 bar, the piston is in a position in which the cross-sectional surface of the orifice-like throttle opening is partially closed off. With increasing pressure the piston begins to be displaced against the force of the spring. In the process the open cross-sectional surface of the orifice-like throttle opening is increased.

Advantageous and useful embodiments of the invention are recited here after. It is particularly useful if the orifice-like throttle opening is arranged so it cannot be displaced in relation to the housing. In this case the piston is designed as a control pin and works together with the orifice-like throttle opening. Here, the control pin becomes displaceable in relation to the orifice-like throttle opening and independently of the piston of the bypass flow control valve. On its one end, the control pin has a profiled tip, and the spring acts on its other end, on the side remote from the profiled tip, in the direction toward a reduction of the cross-sectional surface of the orifice. The tip is usefully designed in the form of a frustum.

In another exemplary embodiment, the orifice is also arranged so it cannot be displaced with respect to the housing. However, the piston is designed as a control piston and works together with the orifice. On its end facing the orifice, the control piston has an essentially flat front face with a recess which connects its front face with its circumferential surface. Usefully, the recess of the control piston is designed in the shape of a transverse slit.

For removing possibly generated leakage oil from the space containing the spring, this space is connected by means of a conduit with a low pressure chamber. The low pressure chamber can be constituted by the surroundings of the pump, or by a suction chamber of the positive-displacement pump.

BRIEF DESCRIPTION OF THE DRAWINGS

The invention will be explained in greater detail in what follows by means of qn exemplary embodiment represented in the drawings. Shown are in FIG. 1 is longitudinal section through the positive-displacement pump of the invention in a first exemplary embodiment.

DETAILED DESCRIPTION OF THE INVENTION

Figure 1:
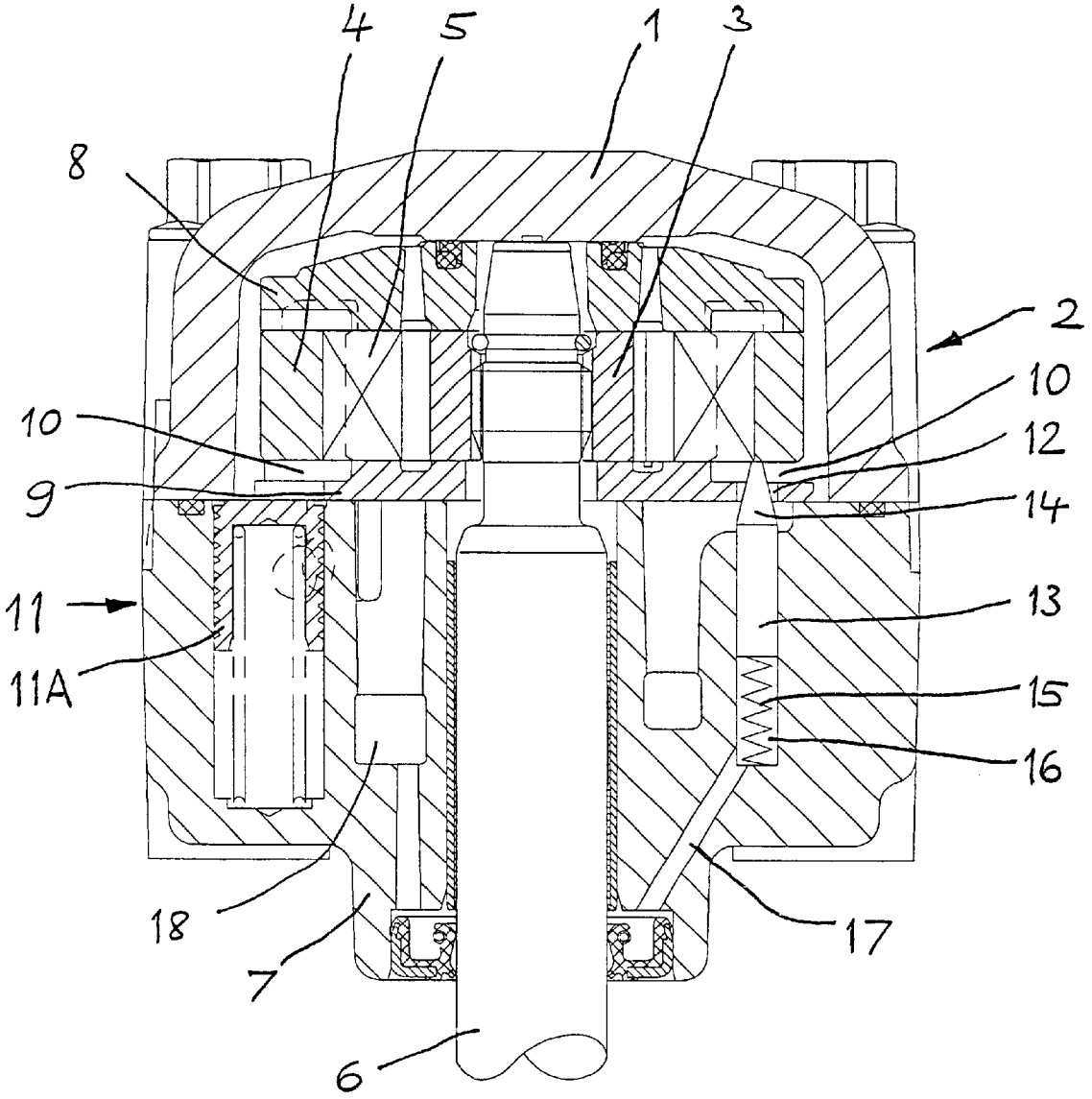

The invention will be described by means of the example of a vane cell pump. However, the invention can be employed with the same effect with other positive-displacement pumps, for example with roller pumps.

A pump package 2 has been installed in a housing 1 and consists of a rotor 3, a cam ring 4 and several operating slides 5. The rotor 3 is seated on a driveshaft 6 in a bearing housing 7.

Work chambers, in the form of displacement cells are formed between the operating slides 5 and the cam ring 4 and are delimited on their two axial sides by two control plates 8 and 9. In a known manner, pressure openings 10 to a pressure chamber and suction openings, from a suction chamber are provided in the control plates 8 and 9.

A bypass flow control valve 11 with a piston 11A has been arranged in a known manner in the housing 1. An orifice 12 of the bypass flow control valve 11 is arranged in the front plate 9 located between the pump package 2 and the bearing housing 7.

A control pin 13 works together with the orifice 12. On its one end the control pin 13 has a profiled tip 14. The tip 14 is preferably designed in the shape of a frustum. A spring 15, which has been inserted into a chamber 16, acts on the other end of the control pin 13. The chamber 16 is connected via a conduit 17 with a low pressure chamber 18 of the positive-displacement pump, which usefully is the suction chamber of the pump.

The spring 15 acts on the control pin 13 in the direction toward its tip 14, so that the frustoconical tip 14 only leaves a relatively narrow cross-sectional surface of the orifice 12 open in the area of the orifice 12. This state occurs at low pressures, for example of 4 bar. If the pressure in the pressure opening 10 rises, the control pin 13 begins to be displaced into the interior of the chamber 15 against the force of the spring 16. In the process the open cross-sectional surface of the orifice 12 is increased, so that the flow rate of the positive-displacement pump can increase.

In the second exemplary embodiment (not shown) a control piston 19 has been employed in place of the control pin 13, which has an essentially flat front face on its end next to the orifice 12. A recess connects the front face of the control piston with its circumferential face at this end. Because of this a relatively narrow flow-through cross section of the orifice 12 is opened in the initial position of the control piston, in which its front face rests against the control plate 9. As soon as the control piston is displaced into the chamber 16 against the force of the spring 15, a larger flow-through cross section is opened relatively rapidly, so that the flow rate of the positive-displacement pump can rise.

In both exemplary embodiments the orifice 12 is arranged so that it cannot be displaced in respect to the housing 1. However, it is possible with the same result to arrange the orifice on the piston, for example on the control piston. In that case the orifice acts together with a control edge formed in the housing 1. This embodiment is easy to imagine and therefore will not be described or represented in greater detail.

In both exemplary embodiments the orifice 12 is designed as a bore in the control plate 9. However, with the same effect the orifice can also be arranged in a separate throttle insert in the control plate 9.

What is claimed is:

1. A positive displacement pump for conveying a pressure medium from a container to a consumer comprising:

a pump package including a housing having a suction chamber and a pressure chamber, a rotor, a cam ring located radially about the rotor, several operating slides inserted into an interior of the housing between the rotor and the cam ring, and control plates located on respective axial sides of operating slides such that work chambers are formed between the cam ring and the rotor, the work chamber being (a) divided by the operating slides, (b) limited in an axial direction by the control plates, and (c) pumping the medium from the suction chamber to the pressure chamber;

a bypass flow control valve which is used for controlling a bypass flow of the medium from the pressure chamber to the suction chamber, the flow control valve having a bypass piston with a proximal end open to the pressure chamber; and a throttle for the bypass flow control valve including a) a throttle opening between the pressure and suction chambers, the throttle having a cross-sectional surface, b) a throttle chamber, c) a throttle member movable in the throttle chamber and having a distal end and a proximal end which adjustably closes the cross-sectional surface of the throttle opening and against which a pressure of the medium in the pressure chamber acts, d) a spring in the throttle chamber which urges the proximal end of the throttle member towards the throttle opening and which opposes the pressure in the pressure chamber, and e) a conduit which connects a side of the throttle chamber adjacent the distal end of the throttle member with the suction chamber, whereby the cross-sectional surface of the throttle opening is varied as a function of the pressure present in the pressure chamber.

2. A positive displacement pump as claimed in claim 1:

wherein the throttle member is a control pin whose proximal end is a profiled tip; and wherein the throttle opening is an orifice.

3. A positive displacement pump as claimed in claim 2:

wherein the throttle opening is fixed with respect to the housing;

wherein the control pin is movable independently of the bypass piston.

4. A positive displacement pump as claimed in claim 3, wherein the profiled tip of the control pin is frustum shaped.

5. A positive displacement pump as claimed in claim 1, wherein the low pressure chamber is a suction chamber of the pump package.

* * * * *